US011725431B2

(12) United States Patent
Moriyama et al.

(10) Patent No.: US 11,725,431 B2
(45) Date of Patent: Aug. 15, 2023

(54) DOOR HANDLE STRUCTURE OF VEHICLE

(71) Applicant: MAZDA MOTOR CORPORATION, Hiroshima (JP)

(72) Inventors: Yukihiro Moriyama, Hiroshima (JP); Eisuke Kuramoto, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 17/512,247

(22) Filed: Oct. 27, 2021

(65) Prior Publication Data

US 2022/0243505 A1 Aug. 4, 2022

(30) Foreign Application Priority Data

Feb. 3, 2021 (JP) ..... 2021-015647

(51) Int. Cl.
*E05B 85/10* (2014.01)
*E05B 81/06* (2014.01)
(Continued)

(52) U.S. Cl.
CPC ..... *E05B 85/103* (2013.01); *E05B 81/06* (2013.01); *E05B 81/36* (2013.01); *E05B 85/16* (2013.01)

(58) Field of Classification Search
CPC ..... E05B 85/103; E05B 85/107; E05B 85/16; E05B 81/06; E05B 81/36; E05B 85/10; E05B 85/18
(Continued)

(56) References Cited

U.S. PATENT DOCUMENTS

2003/0019261 A1* 1/2003 Wittwer ..... E05B 85/107 292/336.3
2014/0000167 A1* 1/2014 Patel ..... E05B 81/34 49/32
(Continued)

FOREIGN PATENT DOCUMENTS

CN 108374615 A * 8/2018 ..... E05B 85/107
EP 3 540 157 A1 9/2019
(Continued)

OTHER PUBLICATIONS

The extended European search report issued by the European Patent Office dated Jun. 3, 2022, which corresponds to European Patent Application No. 21217669.7-1005 and is related to U.S. Appl. No. 17/512,247.

*Primary Examiner* — Kristina R Fulton
*Assistant Examiner* — James Edward Ignaczewski
(74) *Attorney, Agent, or Firm* — Studebaker & Brackett PC

(57) ABSTRACT

A lever is configured to be rotatable around a rotational support axis among a storage position where the lever is flush with a door outer panel, a gripping position where the lever is projected from the door outer panel by driving of a driving unit so that a user is able to grip the lever, and an open position where the lever is further projected from said gripping position. The driving unit is fixed in an opposite area of a hinge arm which is opposite, relative to the rotational support axis, to an area of the hinge arm where the lever is arranged. The above-described area of the hinge arm where the lever is arranged and the driving unit are provided to face each other relative to the rotational support axis when the lever takes the storage position.

11 Claims, 13 Drawing Sheets

(51) Int. Cl.
*E05B 81/36* (2014.01)
*E05B 85/16* (2014.01)

(58) Field of Classification Search
USPC ..... 292/336
See application file for complete search history.

(56) References Cited

U.S. PATENT DOCUMENTS

| | | | | |
|---|---|---|---|---|
| 2019/0284850 | A1* | 9/2019 | Couto Maquieira | E05B 85/107 |
| 2020/0190848 | A1* | 6/2020 | Murata | E05B 83/36 |
| 2021/0156178 | A1* | 5/2021 | Heyduck | E05B 81/42 |
| 2022/0243506 | A1* | 8/2022 | Moriyama | B60J 5/0468 |
| 2022/0243507 | A1* | 8/2022 | Moriyama | E05B 85/103 |

FOREIGN PATENT DOCUMENTS

| | | | | |
|---|---|---|---|---|
| JP | 2020-094455 | A | 6/2020 | |
| WO | WO-2017198917 | A1 * | 11/2017 | E05B 85/107 |
| WO | WO-2019038194 | A1 * | 2/2019 | E05B 77/06 |

* cited by examiner

DOOR HANDLE STRUCTURE OF VEHICLE

BACKGROUND OF THE INVENTION

The present invention relates to a door handle structure of a vehicle comprising a door handle lever (door outer handle) having a flush surface structure, in which the door handle lever is stored in such a manner that the door handle lever is flush with a door panel (door outer panel.

US Patent Application Publication No. 2003/0019261 A1 discloses a door handle lever (hereafter, referred to as "lever" as well) having the flush surface structure, which comprises a swan-neck type of hinge arm which is provided to extend so as to connect the lever and a rotational axis of the lever, wherein the rotational axis is not provided at the lever itself but provided to be spaced apart from the lever along a door outer panel.

The lever can be electrically rotated from a storage position where the lever is stored at the door outer panel to a gripping position where a user is able to grip the lever by using the swan-neck type of hinge arm, thereby projecting the lever outwardly from the door outer panel as a whole. Thereby, the user can easily hold the lever with a finger.

Herein, it is preferable that a counterweight be provided at an opposite-end side of the hinge arm to a one-end side where the lever is arranged relative to the rotational axis so that a gravity position of the hinge arm can be made close to the rotational axis in such a manner that when a large inertia force, such as an impact generated in a vehicle collision, is applied to the hinge arm, the lever provided at the one-end side of the hinge arm is not projected outwardly from the door outer panel so as to prevent the door from being unlocked.

However, there is a problem in that because a driving mechanism to electrically rotate the hinge arm is generally arranged at the above-described opposite-end side of the hinge arm, this counterweight may not be properly provided at its ideal position, i.e., the opposite-end side of the hinge arm.

The door handle structure disclosed in the above-described patent document has the same problem as well. That is, in this door handle structure, while a control arm (43) which corresponds to the above-described counterweight is provided at the hinge arm, the driving mechanism is provided on a door-side at the above-described opposite-end side of the hinge arm via a bracket and the like. Thus, it has the problem in that the counterweight may not be properly provided at the above-described opposite-end side of the hinge arm.

SUMMARY OF THE INVENTION

An object of the present invention is to provide a door handle structure of a vehicle comprising the swan-neck type of hinge arm to be electrically rotated which can properly perform the counterweight function to prevent the lever from being projected from the door panel (door outer panel) when the large inertia force is applied to the hinge arm.

The present invention is a door handle structure of a vehicle, comprising a hinge arm having a lever to be gripped by a user and a rotational support axis to rotate the lever so as to be projected from the door panel, and a driving unit to transmit a drive force to the hinge arm, wherein the lever is configured to be rotatable among a storage position where the lever is flush with the door panel, a gripping position where the lever is projected from the door panel by driving of the driving unit so that the user is able to grip the lever, and an open position where the lever is further projected from the gripping position, the driving unit is fixed in an opposite area of the hinge arm which is opposite, relative to the rotational support axis, to an area of the hinge arm where the lever is arranged, and the area of the hinge arm where the lever is arranged and the driving unit are provided to face each other relative to the rotational support axis when the lever takes the storage position.

According to the present invention, since the driving unit is arranged in the opposite area of the hinge arm which is opposite, relative to the rotational support axis, to the area of the hinge arm where the lever is arranged, the gravity position of the hinge arm becomes properly close to the rotational support axis. Further, the driving unit and the lever can be rotated integrally by driving of the driving unit. Accordingly, the driving unit itself as a heavy object can be made to perform the counterweight function for the lever.

Thus, the lever can be prevented from being improperly projected from the door panel when the large inertia force is applied to the hinge arm, without providing any additional counterweight in the opposite area of the hinge arm.

In an embodiment of the present invention, the hinge arm is attached to a member which is provided on a side of the door panel so as to rotate via the rotational support axis, a wire harness connected to the driving unit is provided, and the wire harness is fixed to a portion of the member which is closely positioned to the rotational support axis.

According to this embodiment, even if a connection portion of the wire harness is moved according to the position change of the lever because of rotating of the hinge arm where the driving unit is fixed around the rotational support axis, the length of the wire harness between its connection portion to the driving unit and its fixation portion where the wire harness is fixed closely to the rotational support axis can be suppressed from changing.

Accordingly, a load of a tensional direction or a compressive direction which is inputted to the wire harness when the hinge arm is rotated around the rotational support axis can be reduced, so that the above-described counterweight-function performance of the driving unit can be achieved without deteriorating the durability of the wire harness.

In another embodiment of the present invention, the lever and the driving unit are provided to face each other relative to the rotational support axis.

According to this embodiment, since the lever which is provided at the farthest position from the rotational support axis and the driving unit are provided to face each other relative to the rotational support axis, the gravity position of the hinge arm can be made close to the rotational support axis.

In another embodiment of the present invention, a bracket which stores the lever and is fixed to the door panel and a sector gear which is fixed to the bracket are provided, and the driving unit comprises a motor, an output axis to transmit a power of the motor to the hinge arm, and a pinion gear which the output axis is fitted into and engages with the sector gear.

According to this embodiment, by gear engagement, i.e., engaging of the sector gear and the pinion gear, the motor power can be transmitted to the hinge arm and also the motor and the pinion gear can be moved together with the hinge arm along an engaging portion of the sector gear with the pinion gear.

That is, a structure in which the driving unit to perform the counterweight function for the lever is provided in the opposite area of the hinge arm can be provided, so that the gravity position of the hinge arm can be arranged closely to the rotational support axis.

Herein, the above-described member provided on the side of the door panel can be configured as the above-described bracket or any other member than this bracket as long as that is any member provided on the side of the door panel which is not the hinge arm nor a member which is rotated together with this hinge arm.

In another embodiment of the present invention, the sector gear is fixed to the rotational support axis of the hinge arm.

According to this embodiment, since poisoning of the sector gear and the rotational support axis around which the hinge arm is rotated can be made precisely, the structure in which the driving unit is fixed in the opposite-side area of the hinge arm so as to be movable together with the hinge arm can be provided.

Accordingly, the gravity position of the hinge arm can be securely arranged closely to the rotational support axis.

In another embodiment of the present invention, the driving unit comprises a motor and a water-proof member which covers over the motor, and has a harness connection portion where the wire harness is connected, and the harness connection portion is positioned at the water-proof member.

According to this embodiment, water can be prevented from coming into an inside of the motor by providing the water-proof member covering over the motor (water-proof cap). Further, since the harness connection portion which becomes an electoral contact point is positioned at the water-proof member (water-proof cap) which is provided at an upper side, even if some water comes into an inside of a vehicle door and then remains at a lower portion of the driving unit, the harness connection portion can be suppressed from becoming wet with the water. Accordingly, the durability of the driving unit against the water can be improved.

The present invention will become more apparent from the following description which refers to the accompanying drawings.

DETAILED DESCRIPTION OF THE INVENTION

Figure 2:
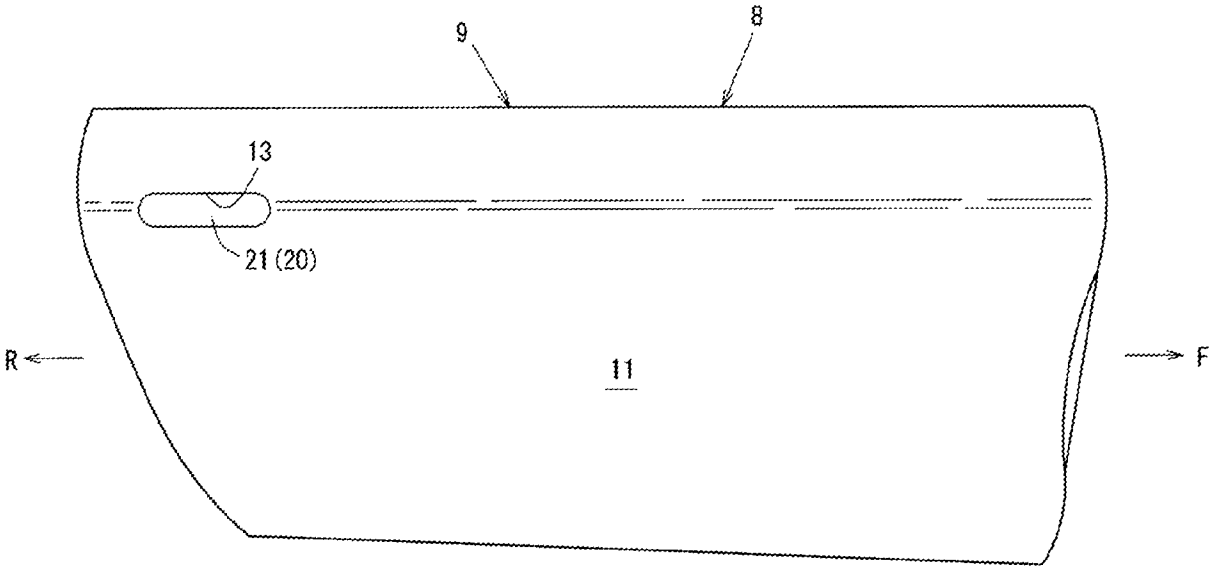
FIG. 2 is a major-part enlarged side view of FIG. 1.
Figure 3:
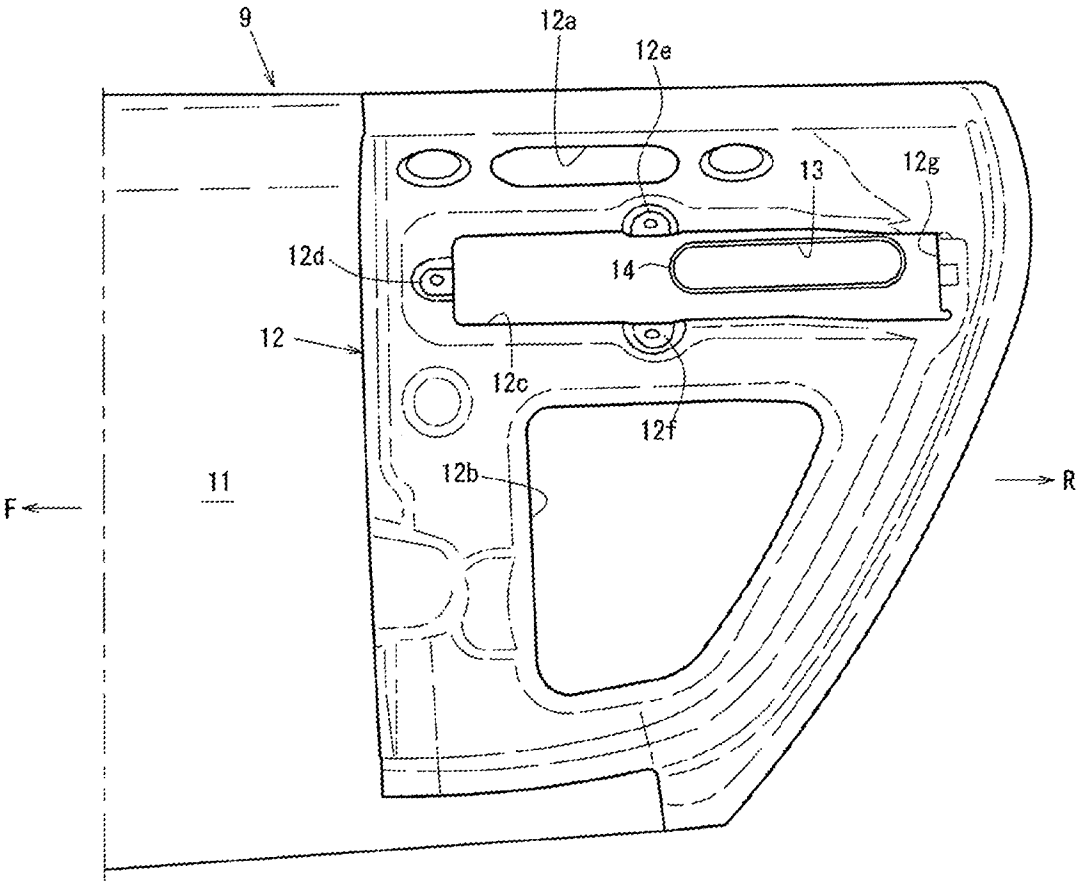
FIG. 3 is an inner side view showing an arrangement structure of a reinforcement.

An embodiment of the present invention will be described specifically referring to the drawings. The drawings show a door handle structure of the vehicle, and FIG. 1 is a side view of a vehicle which has the present door handle structure, FIG. 2 is a major-part enlarged side view of FIG. 1, and FIG. 3 is an inner side view showing an arrangement structure of a reinforcement.

In the figures, an arrow F shows a vehicle forward side, an arrow R show a vehicle rearward side, an arrow UP shows a vehicle upward side, and an arrow OUT shows an outward side, in a vehicle width direction. While the door handle structure of the vehicle of the present invention is applicable to a front door, a rear door, a lift gate or the like of a four-door type of vehicle, an application structure to a door of a two-door type of vehicle will be described specifically in the following embodiments.

Figure 1:
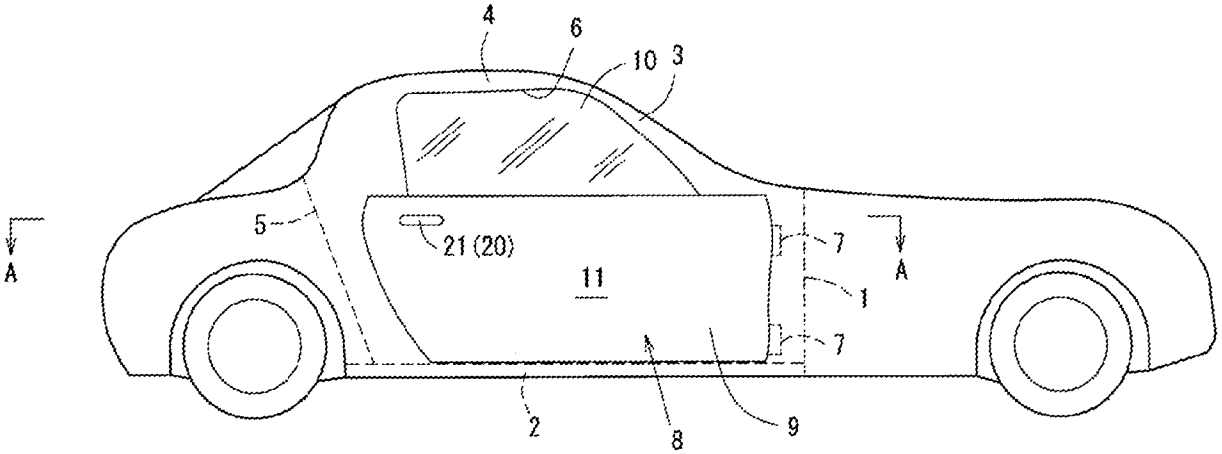
FIG. 1 is a side view of a vehicle which has a door handle structure of the present invention.

As shown in FIG. 1, the vehicle comprises a hinge pillar 1 which extends in a vertical direction at a front portion of a cabin, a side sill 2 which extends in a vehicle longitudinal direction at a vehicle lower portion, a front pillar 3 which extends obliquely rearwardly-and-upwardly from an upper end of the hinge pillar 1, a roof side rail 4 which rearwardly extends continuously from a rear end of the front pillar 3, and a rear pillar 5 which interconnects substantially vertically the roof side rail 4 and the side sill 2.

A door opening potion 6 which is partitioned by the hinge pillar 1, the side sill 2, the front pillar 3, the roof side rail 4, and the rear pillar 5 is formed. The door opening portion 6 is closed or opened with a side door 8 which is rotatably attached to the hinge pillar 1 via a pair of upper-and-lower door hinges 7, 7.

As shown in FIGS. 1 and 2, the side door 8 comprises a door body 9 and a door window glass 10 as a door window member, and as shown in FIGS. 2 and 3, the door body 9 comprises a door outer panel 11, a door inner panel (not illustrated), and a reinforcement 12 which is provided on an inward side, in the vehicle width direction, of the door outer panel 11 and at a rear side of the door body 9. In the present embodiment, the door panel is constituted by the door outer panel 11 and the reinforcement 12.

As shown in FIG. 3, at an upper-rear side of the door outer panel 11 as the door panel are provided an opening portion 13 (lever opening portion) which stores a lever 20, which will be described later, and a flange 14 which is formed by bending an edge portion of the opening portion 13 over its entire periphery by baring processing.

Further, as shown in FIG. 3, an upper opening 12*a* and a lower opening 12*b* are respectively formed at an upper side and a lower side of the reinforcement 12, and an opening portion 12*c* (bracket opening portion) for attaching a bracket 50, which will be described later, is formed between the both openings 12*a*, 12*b*.

Figure 4:
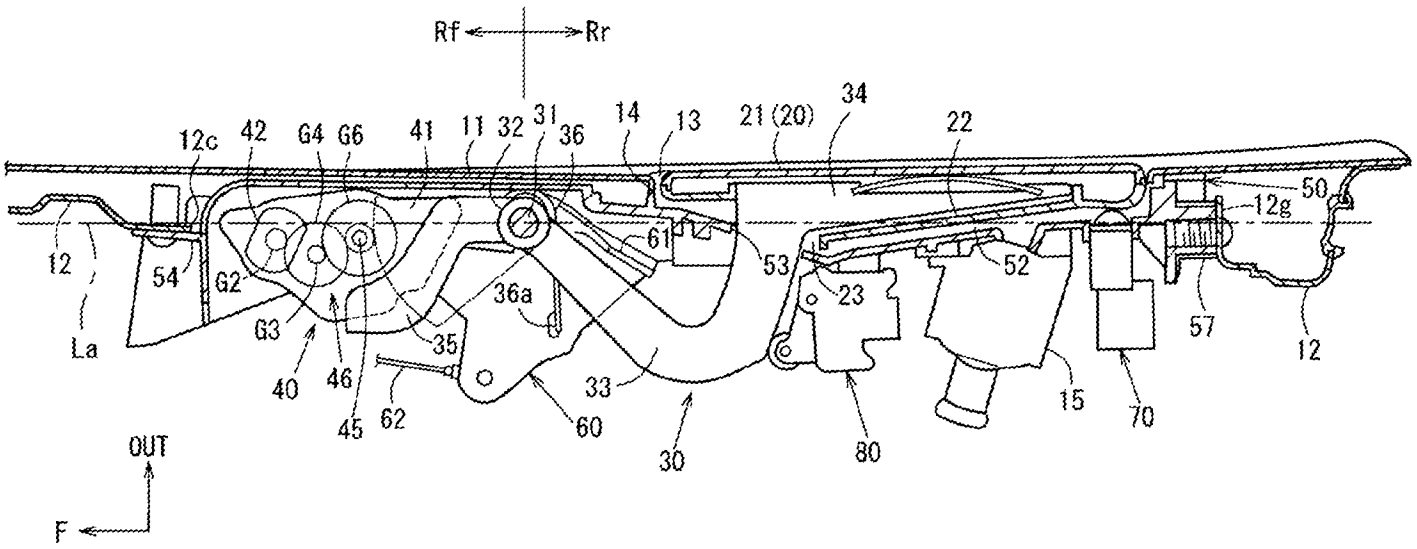
FIG. 4 is a sectional view taken along line A-A of FIG. 1, which shows a storage position of a lever.
Figure 5:
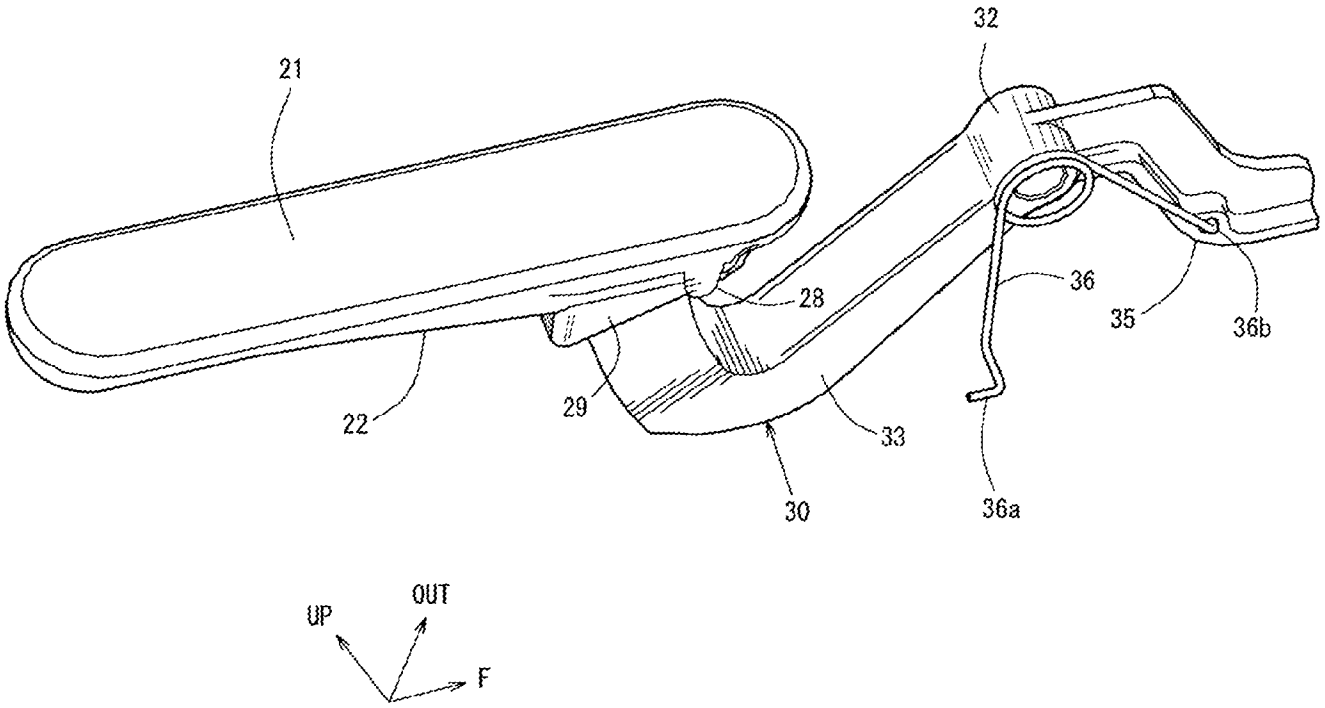
FIG. 5 is a perspective view of the lever and a hinge arm.
Figure 6:
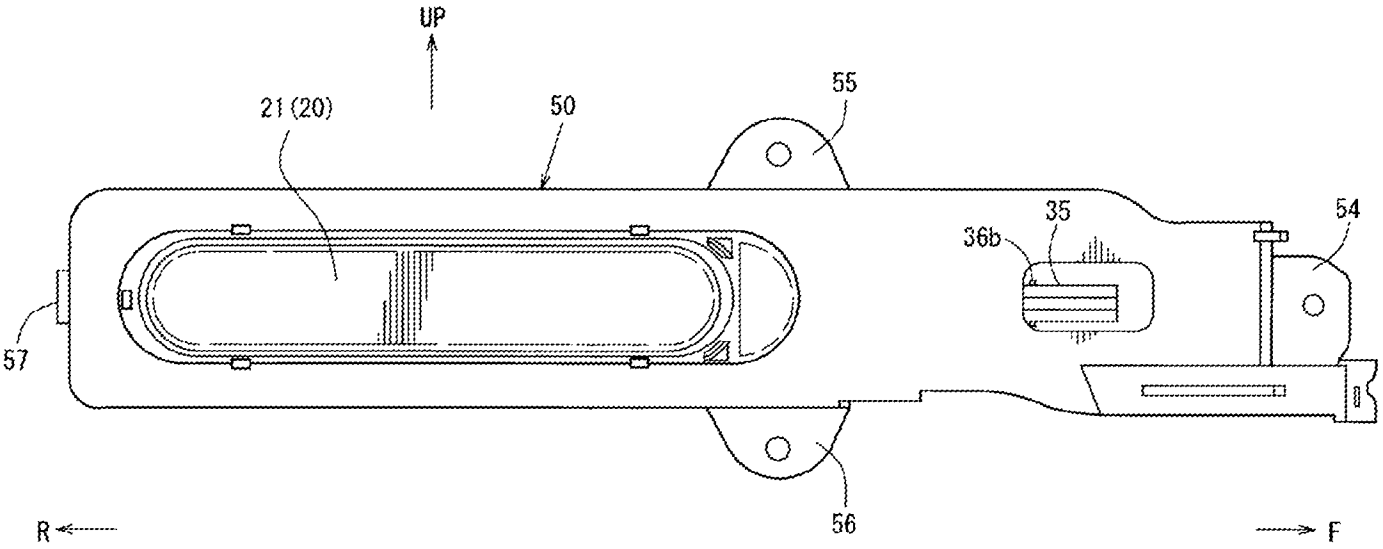
FIG. 6 is an outer side view of a bracket including the lever.

FIG. 4 is a sectional view taken along line A-A of FIG. 1, which shows a storage position of the lever 20, FIG. 5 is a perspective view of the lever 20 and a hinge arm 30, and FIG. 6 is an outer side view of the bracket 50 including the lever 20.

Figure 7:
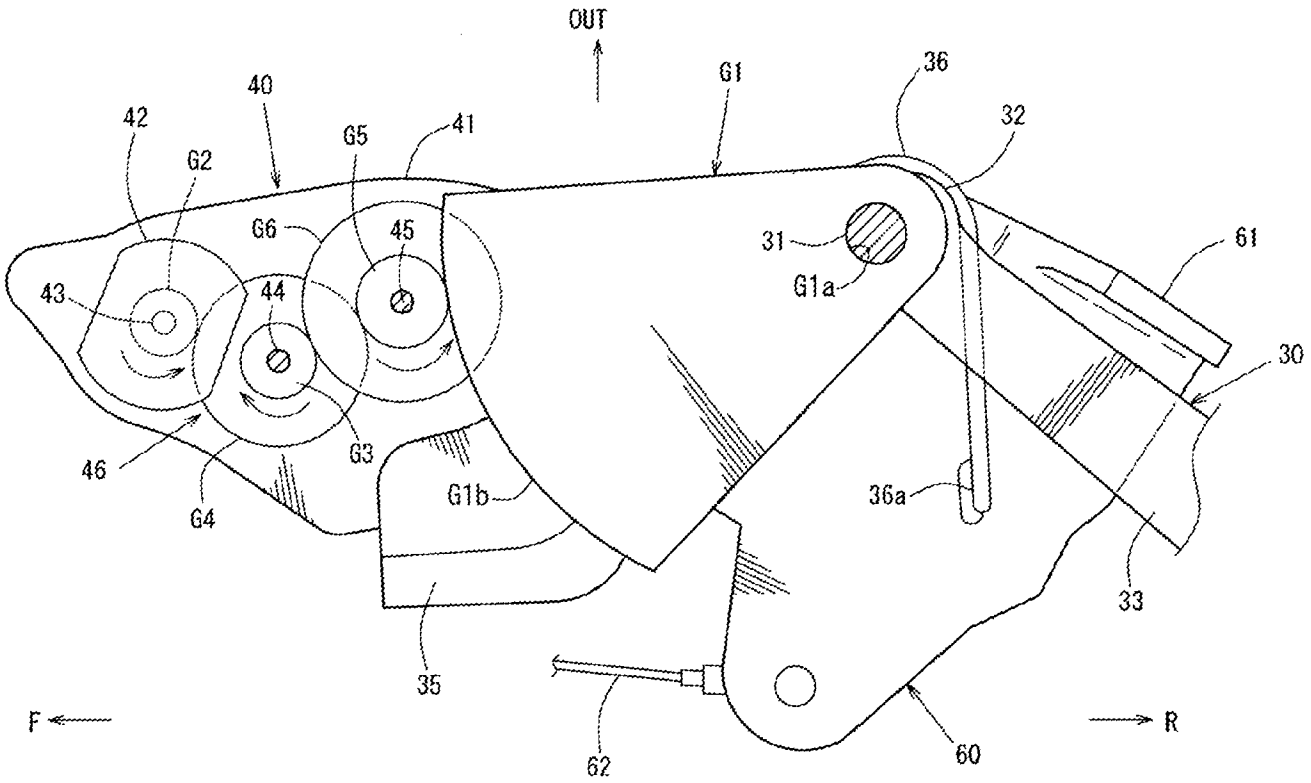
FIG. 7 is a plan view showing a driving unit.
Figure 8:
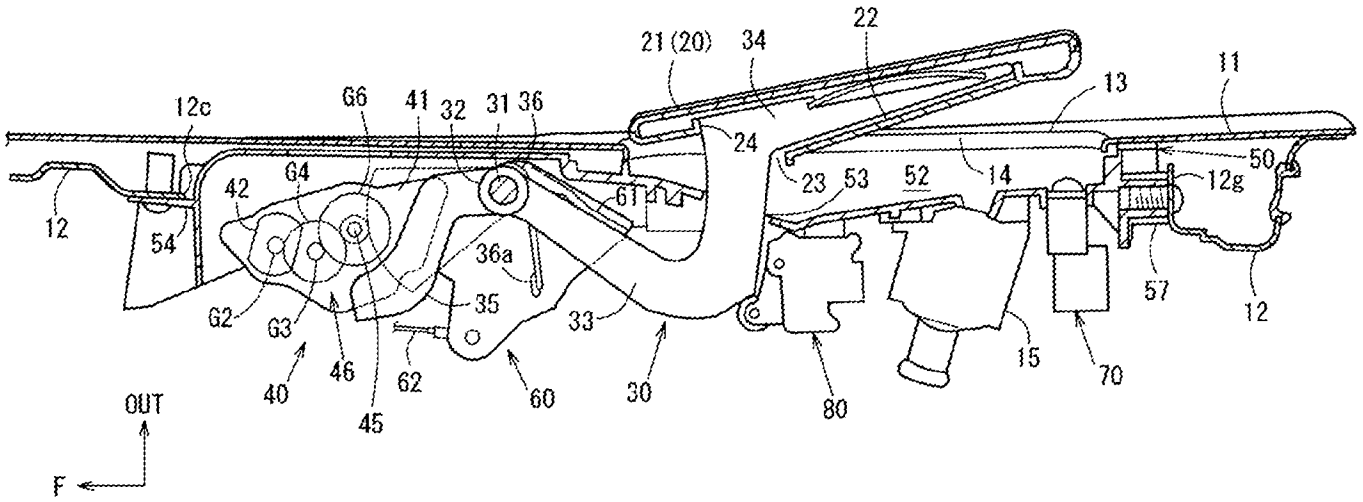
FIG. 8 is a plan view showing a gripping position of the lever.
Figure 9:
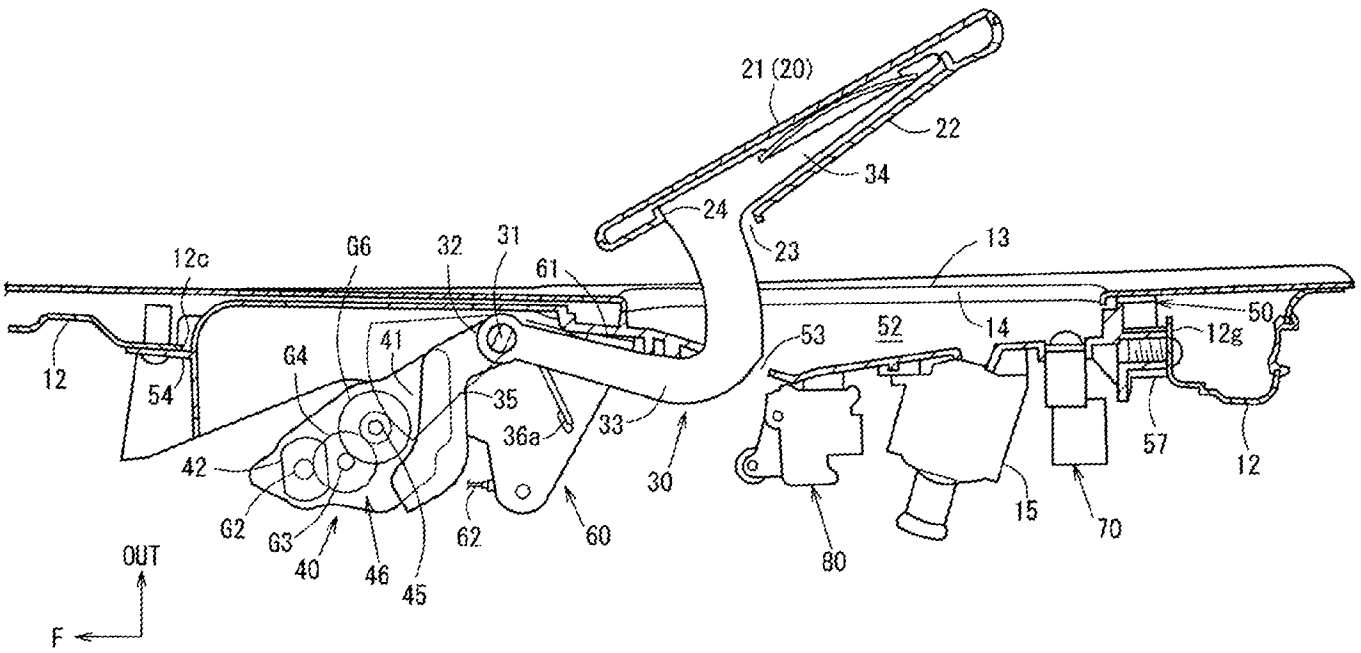
FIG. 9 is a plan view showing an open position of the lever.
Figure 10:
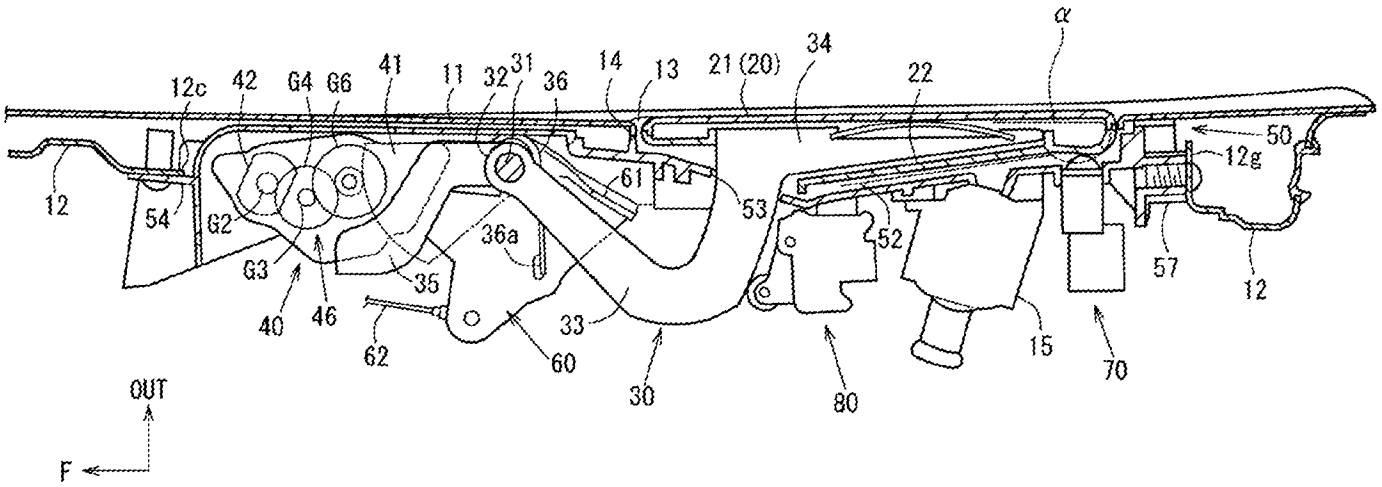
FIG. 10 is a plan view showing a pushing position of a switch by using an imaginary line.

Further, FIG. 7 is a plan view showing a driving unit 40, FIG. 8 is a plan view showing a gripping position of the lever 20, FIG. 9 is a plan view showing an open position of the lever 20, and FIG. 10 is a plan view showing a pushing position of a switch 70 by using an imaginary line a.

As shown in FIG. 4, the present door handle structure of the vehicle comprises the lever 20 (specifically, door handle lever) which is retractable from the opening portion 13 of the door outer panel 11 as the door panel, a swan-neck type of hinge arm 30 with the lever 20, and the driving unit 40 to transmit a drive force to the hinge arm 30 so as to project the lever 20 from the door outer panel 11. Further, there is provided the bracket 50 which is fixed to the reinforcement 12 as a door panel so as to store the lever 20 therein.

The lever 20 is formed by an outer cover 21 shown in FIGS. 4 and 5 and an inner cover 22 which are fitted together in a convex/concave connection manner or fixedly joined together at their peripheral edge portions, and the lever 20 and the opening portion 13 of the door outer panel 11 are respectively formed in an elongated circular shape which is relatively-long in a vehicle longitudinal direction in a side view.

As shown in FIG. 5, a protrusion portion 28 is formed at a front side of an opening 23 (see FIG. 4) where the hinge arm 30 provided outside of the inner cover 22 is inserted. This protrusion portion 28 is of a tongue-piece shape and configured to contact a facing wall (not illustrated) of the bracket 50 and function as a fulcrum in a swinging action of the lever 20.

Further, as shown in FIG. 5, a cylindrical portion 29 which is spaced apart from the hinge arm 30 and encloses the hinge arm 30 is formed at an inward side, in the vehicle width direction, of the opening 23 (see FIG. 4). As show in FIG. 4, the hinge arm 30 has the above-described lever 20 at its one end (its rear end in the present embodiment), and is provided with a hinge pin 31 as a rotational support axis around which the lever 20 is rotated in such a manner that the lever 20 is projected from the door outer panel 11. This hinge pin 31 is fixed to the bracket 50 such that it extends in the vertical direction.

Moreover, as shown in FIG. 4, the hinge arm 30 comprises a pivotal portion 32 to pivotally support the hinge pin 31, a lever support portion 34 which extends rearwardly from the pivotal portion 32 via a swan-neck shaped neck portion 33, and an extension portion 35 which extends forwardly, in an opposite direction to the neck portion 33, from the pivotal portion 32 via the swan-neck shaped neck portion 33, which are formed integrally. The lever support portion 34 is arranged inside the lever 20 which is formed by the outer cover 21 and the inner cover 22.

As shown in FIG. 4, a motor base 41 for assembling the driving unit 40 is attached to the extension portion 35 of the hinge arm 30. Also, as shown in FIG. 4, a crank plate 60 is provided coaxially with the hinge pin 31. A vertical wall 61 which contacts and engages with the neck portion 33 of the hinge arm 30 when the lever 20 and the hinge arm 30 are rotated at the gripping position (see FIG. 8) is integrally formed at an rearward-and-outward side, in the vehicle width direction, of the crank plate 60.

Moreover, a release wire 62 for releasing a door latch (not illustrated) is fixed to an inward end, in the vehicle width direction, of the crank plate 60. This crank plate 60 is always biased in an anti-release direction by means of a coil spring (not illustrated) having a large spring force.

Meanwhile, a torsion spring 36 as a biasing mechanism is wound around the hinge pin 31. One end 36*a* of the torsion spring 36 engages with the crank plate 60 shown in FIG. 4, and the other end 36*b* of the torsion spring 36 engages with the extension portion 35 of the hinge arm 30 as shown in FIG. 5. Thereby, the lever 20 is always biased in its storage direction by means of the torsion spring 36. A spring force of this torsion spring 36 is set to be smaller than that of the coil spring (not illustrated) which biases the crank plate 60 in the anti-release direction.

Next, a sector gear G1 which is provided at the above-described bracket 50 and a structure of the driving unit 40 to transmit the drive force to the other side (see the extension portion 35) of the hinge arm 30 in cooperation with this sector gear G1 will be described referring to FIG. 7. The sector gear G1 is made of a plate-shaped member which is of a fan shape and fixed to the hinge pin 31 which pivotally support the hinge arm 30. Further, this sector gear G1 is fixed to the bracket 50 so as not to change its position relative to the bracket 50.

A penetration hole G1*a* is formed at the sector gear G1, and the hinge pin 31 is fitted into this penetration hole G1*a*, so that the sector gear G1 is fixed to the hinge pin 31 as described above.

The above-described penetration hole G1*a* is positioned at a center of an arc-shaped engagement portion G1*b* of the sector gear G1 which engages with the pinion gear G5.

The driving unit 50 comprises a motor 42, a gear train 46 which comprises respective elements G2-G6, and the motor base 41 for assembling these 42, 46.

Specifically, the motor 42 is attached to the motor base 41. A rotational axis 43 of the motor 42 is fitted into an output gear G2. An idle gear G4 having a pinion gear G3 is provided at an axis 44 which is provided at the motor base 41. Further, a driven gear G6 having a pinion gear G5 is provided at another axis 45 which is provided at the motor base 41. The above-described output axis 45 is an axis to transmit an output of the motor 42 to the hinge arm 30 via the pinion gear G5.

As shown in FIG. 7, the output gear G2 engages with the idle gear G4. The pinion gear G3 engages with the driven gear G6. The pinion gear G5 engages with the sector gear G1. Thereby, when the motor 42 is driven and the rotational axis 43 and the output gear G2 are rotated in a counterclockwise direction in FIG. 7, the pinion gear G5 is finally rotated in the counterclockwise direction in FIG. 7 through respective rotations of the gears G2, G4, G3, G6 and the output axis 45 which are provided in this order.

As the pinion gear G5 is rotated in the counterclockwise direction in FIG. 7, the driving unit 40, i.e., the motor 42, the gear train 46 comprising the gears G2-G6, and the motor base 41 move in a projection direction of the lever 20 along the arc-shaped engagement portion G1*b* of the arc-shaped sector gear G1 with the pinion gear G5 because the position of the sector gear G1 does not change, so that the lever 20 is projected via the hinge arm 30.

Further, since the motor base 41 is attached to the extension portion 35 of the hinge arm 30 as described above, the driving unit 40 is rotated, together with the hinge arm 30, around the hinge pin 31, so that the lever 20 can be projected from the door outer panel 11.

The above-described lever 20 is configured to be rotatable among the storage position (see FIG. 4) where the outer cover 21 of the lever 20 is flush with the door outer panel 11, the gripping position (see FIG. 8) where a whole part of a design surface of the lever 20 is projected from the door outer panel 11 by the driving unit 40 so that a user is able to grip the lever 20, and the open position (see FIG. 9) where the lever 20 is further projected from the gripping position.

The lever 20 can be rotated by the driving unit 40 between the storage position shown in FIG. 4 and the gripping position shown in FIG. 8. Further, the crank plate 60 is biased in the anti-release direction by the coil spring (not illustrated) having the strong spring force, not moving between these positions.

In the gripping position shown in FIG. 8, the lever 20 is projected outwardly from the door outer panel 11 so that the user can grip the lever 20, so that the lever 20 can be moved by the user from the gipping position shown in FIG. 8 to the open position shown in FIG. 9.

When the hinge arm 30 reaches the gripping position as shown in FIG. 8, the neck portion 33 of the hinge arm 30 contacts the vertical wall 61 of the crank plate 60. Accordingly, as the lever is rotated in an open direction of the lever 20 against the spring force of the coil spring, not illustrated, the crank plate 60 is moved in a release direction, thereby releasing the door latch via the release wire 62.

Herein, as shown in FIG. 4, the bracket 50 has a storage space 52 of the lever 20 which is inserted into the opening portion 13 and an insertion hole 53 of the hinge arm 30. Further, as shown in FIG. 6, the bracket 50 comprises a front-side attachment portion 54, an upper-side attachment portion 55, a lower-side attachment portion 56, and a rear-side attachment portion 57.

As shown in FIGS. 6 and 3, the front-side attachment portion 54 of the bracket 50 is fixedly fastened to a front-side attachment base 12*d* provided at a peripheral edge of the opening portion 12*c* of the reinforcement 12. Likewise, the upper-side and lower-side attachment portions 55, 56 are fixedly fastened to an upper-side attachment base 12*e* and a lower-side attachment base 12*f* which are provided at the peripheral edge of the opening portion 12*c* of the reinforcement 12.

As shown in FIGS. 3 and 4, an erected portion 12*g* which extends outwardly is integrally formed at a rear-side periphery of the opening portion 12*c* of the reinforcement 12, and the rear-side attachment portion 57 of the bracket 50 which is shown in FIG. 7 is fixedly fastened to the erected portion 12*g*.

Meanwhile, as shown in FIG. 4, a switch 70 is arranged at a vehicle inward side of the lever 20 taking the storage position, specifically, at an inward side, in the vehicle width direction, of a rear-end side of the bracket 50 which faces a rear end portion of the inner cover 22. This switch 70 is electrically connected to the motor 42 via a control unit and configured to be turned ON when being pushed by operation, thereby feeding the electricity to the motor 42.

Figure 12:
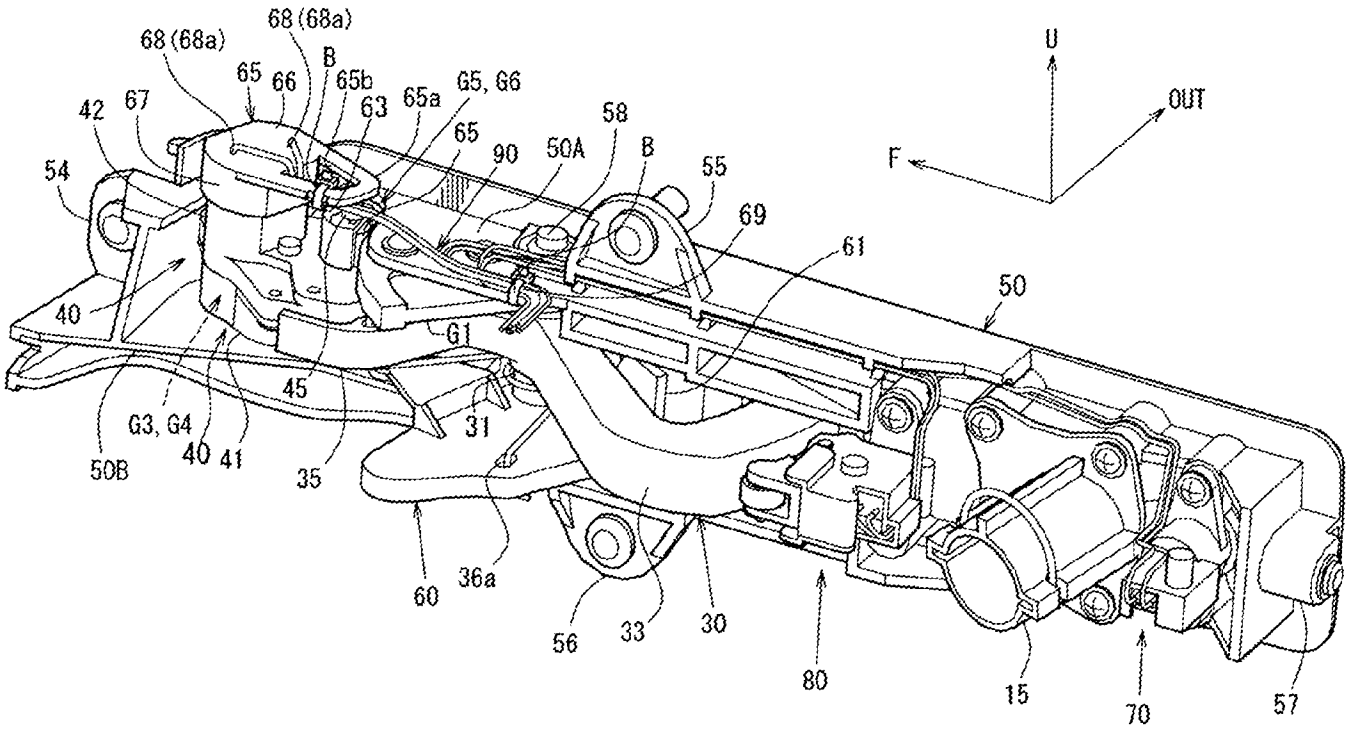
FIG. 12 is a perspective view of the major part of the door handle structure, when viewed obliquely from a rearward, inward, in the vehicle width direction, and upward side of the structure.

Further, a key cylinder 15 is, as shown in FIG. 4, arranged at the bracket 50 which is forwardly close to the switch 70. Further, as shown in FIG. 4, in the storage position of the lever 20, a temporary holding mechanism 80 to temporarily hold the hinge arm 30 at the gripping position shown in FIG. 12 is arranged at a specified position of the bracket 50 between the neck portion 33 of the hinge arm 30 and the key cylinder 15.

As shown in FIG. 10, since the lever 20 is configured to be swingable relative to the lever support portion 34 of the hinge arm 30, when the rear end portion of the lever 20 positioned in the storage position is pushed from an outward side, the rear end portion of the lever 20 is moved so as to swing inwardly, in the vehicle width direction, as shown by an imaginary line a in FIG. 10, so that a switch pushing position where the switch 70 is turned ON is taken.

Figure 11:
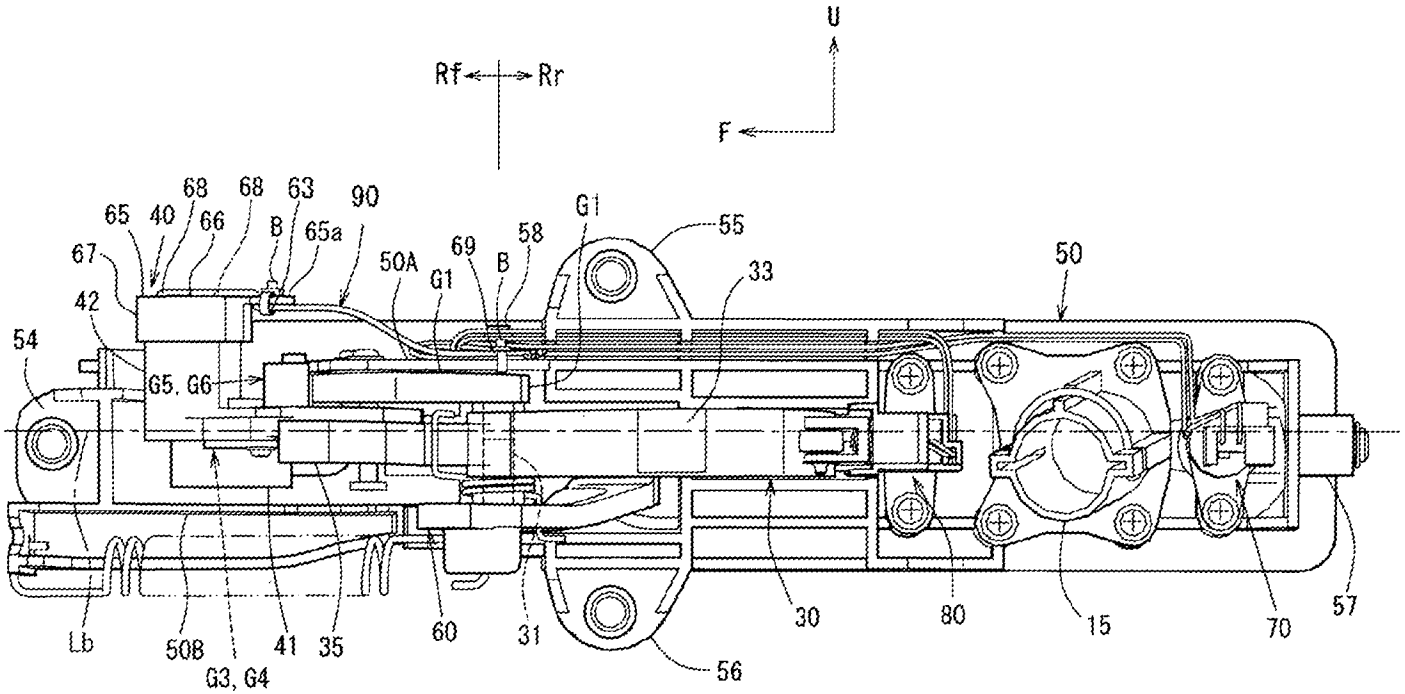
FIG. 11 is a side view of a major part of the door handle structure, when viewed from an inward side, in a vehicle width direction, of the structure.

FIG. 11 is a side view of a major part of the door handle structure, when viewed from an inward side, in the vehicle width direction, of the structure. As shown in FIGS. 4 and 11, the hinge arm 30 is provided with the lever 20 (the outer cover 21 and the inner cover 22), the neck portion 33, the lever support portion 34, and others in its one-side area, i.e., in a rear-side area Rr which is located on a rearward side of the hinge pin 31.

Further, the driving unit 40 is fixed in an opposite area of the hinge arm 30 which is opposite, relative to the hinge pin 31, to an area of the hinge arm 30 where the lever 20 is arranged, i.e., in a front-side area Rf which is located on a forward side of the hinge pin 31.

When the lever 20 takes the storage position, the rear-side area Rr of the hinge area 30 and the driving unit 40 which is provided in the front-side area Rf face each other relative to the hinge pin 31. That is, in the present embodiment, the rear-side area Rr and the driving unit 40 are arranged such that at least parts of these overlap with each other in a vehicle elevational view.

Specifically, the lever 20 (the inner cover 22) and the lever support portion 34 which are arranged in the rear-side area Rr, the hinge pin 31, and the motor 42 which has the heaviest weight among components constituting the driving unit 40 provided in the front-side area Rf are arranged on an identical straight line extending in the longitudinal direction (see an imaginary line La in FIG. 4) in a state shown in FIG. 4 (in a vehicle plan view of the structure). Meanwhile, in a state shown in FIG. 11 (in an inward side view, in the vehicle width direction, of the structure), these are arranged on an identical straight line extending in the longitudinal direction (see an imaginary line Lb in FIG. 11).

FIG. 12 is a perspective view of the major part of the door handle structure, when viewed obliquely from a rearward, inward, in the vehicle width direction, and upward side of the structure. As shown in FIG. 12, the driving unit 40 is provided with a water-proof cap 65 which is attached over the motor 42.

The water-proof cap 65 is made of resin, rubber, or the like which have the water resistance, and comprises an upper wall portion 66 and a peripheral wall portion 67 which extends downwardly from an entire periphery of the upper wall portion 66, which is configured to be upwardly recessed. This water-proof cap 65 is attached tightly to an upper side of the motor 42 so as to cover over the motor 42. Further, a projection piece 65*a* which projects rearwardly is integrally formed at a rear portion of the upper wall portion 66 of the water-proof cap 65, and a penetration hole 65*b* which penetrates the projection piece 65*a* vertically is formed at a central portion of the projection piece 65*a* in a plan view.

Further, as shown in this figure, the motor 42 is arranged at the motor base 41 such that it projects upwardly relative to the gears G3, G4, G5, G6. In other words, the motor 42 is arranged such that it projects upwardly beyond an upper wall 50A of the bracket 50.

Thereby, the motor 42 is arranged so that at least the upper side of the motor 42 can be suppressed from becoming wet with the water even if the water remains at a lower wall 50B of the bracket 50.

Further, as shown in FIGS. 11 and 12, the driving unit 40 which is fixed to the hinge arm 30 and various kinds of electrical devices which are mounted on the bracket 50 and the like are electrically connected by a wire harness 90. For example, the switch 70 and the motor 42 are electrically connected by the wire harness 90 so that the motor 42 can be energized when the switch 70 (see FIGS. 11 and 12) is turned ON.

Herein, in other figures than FIGS. 11 and 12, illustration of the wire harness 90 and the water-proof cap 65 is omitted.

The wire harness 90 is connected to the upper wall portion 66 of the water-proof cap 65 on the side of the driving unit 40 (i.e., on a movable-portion side). Hereafter, a connection portion 68 of the wire harness 90 which is positioned on the side of the driving unit 40 will be referred to as the "harness connection portion 68."

Specifically, a harness insertion hole 68*a* (see FIG. 12) is provided to vertically penetrate the upper wall portion 66 of the water-proof cap 65. A one-end side of the wire harness 90 is inserted into the harness penetration hole 68*a* from an upper-face side of the upper wall portion 66 and held there. Thereby, the harness connection portion 68 is positioned at the upper wall portion 66 of the water-proof cap 65. Further, an inserted-end portion of the wire harness 90 into the harness insertion hole 68*a* is electrically connected to the motor 42 which is positioned at a lower side of the upper wall portion 66 of the water-proof cap 65 (not illustrated).

Herein, the wire harness 90 extends down the projection piece 65*a* from the harness connection portion 68 which is positioned at the upper wall portion 66 of the water-proof cap 65, passing through the penetration hole 65*b* of the projection piece 65*a* of the water-proof cap 65, and then extends up to the side of the bracket 50 (i.e., to the fixation-portion side). The wire harness 90 is fixed to an edge portion of the penetration hole 65*b* of the projection piece 65*a* by a band B. This fixation portion is referred to as a "harness movable-side fixation portion 63" as well.

Meanwhile, the wire harness 90 is fixed, by the band B, to a portion of the bracket 50 which is positioned closely to the hinge pin 31, specifically to a portion of the upper wall portion 66 of the bracket 50 which is positioned closely to an inward side, in the vehicle width direction, of a pin attachment portion 58 where the one end (upper end) of the hinge pin 31 is fixedly attached (i.e., to the portion of the upper wall portion 66 which is positioned closely to a side where the harness connection portion 68 is provided (see FIG. 12)). Herein, this fixation portion is referred to as a "harness fixation portion 69."

Further, as shown in FIGS. 11 and 12, the harness fixation portion 69 which is close to the pin attachment portion 58 (hinge pin 31) is positioned between the harness connection portion 68 and the sector gear G1 which is fixed to the hinge pin 31.

By providing the harness fixation portion 69 at this position, the harness connection portion 68 and the harness fixation portion 69 can be positioned as closely to each other as possible in a direction (in the vehicle width direction) where the harness connection portion 68 is not displaced relative to the harness fixation portion 69 when the harness connection portion 68 is moved according to the position change of the lever 20. Consequently, an excessive length of the wire harness 90 connecting the harness connection portion 68 and the harness fixation portion 69 can be properly diminished.

As shown in FIG. 4, the door handle structure of the vehicle of the above-described embodiment comprises the hinge arm 30 having the lever 20 to be gripped by the user and the hinge pin 31 (rotational support axis) to rotate the lever 20 so as to be projected from the door outer panel 11 (door panel), and the driving unit 40 to transmit the drive force to the hinge arm 30, wherein the lever 20 is configured to be rotatable among the storage position (see FIG. 4) where the lever 20 is flush with the door outer panel 11, the gripping position (see FIG. 8) where the lever 20 is projected from the door outer panel 11 by driving of the driving unit 40 so that the user is able to grip the lever 20, and the open position (see FIG. 9) where the lever 20 is further projected from the gripping position, as shown in FIG. 4, the driving unit 40 is fixed in the front-side area Rf (opposite area) of the hinge arm 30 which is opposite, relative to the hinge pin 31, to the rear-side area Rr of the hinge arm 30 where the lever 20 is arranged, and as shown in FIGS. 4 and 11, the rear-side area Rr of the hinge arm 30 and the driving unit 40 are provided to face each other relative to the hinge pin 31 when the lever 20 takes the storage position.

According to this structure, as shown in FIGS. 4 and 11, since the driving unit 40 is arranged in the front-side area Rf of the hinge arm 30 which is opposite, relative to the hinge pin 31, to the rear-side area Rr of the hinge arm 30 where the lever 20 is arranged and the rear-side area Rr of the hinge arm 30 and the driving unit 40 are provided to face each other relative to the hinge pin 31 when the lever 20 takes the storage position, the gravity position of the hinge arm 30 becomes close to the hinge pin 31 and the driving unit 40 and the lever 20 can be rotated integrally by driving of the driving unit 40.

Accordingly, the driving unit 40 itself as a heavy object which is arranged in the front-side area Rf of the hinge arm 30, which is an ideal layout position of the counterweight, can be made to perform the counterweight function for the lever 20.

Thus, the lever 20 can be prevented from being improperly projected from the door outer panel 11 when the large inertia force is applied to the hinge arm 30, without avoiding a situation where the counterweight improperly interferes with the driving unit 40, which may be caused by providing any additional counterweight in the front-side area Rf of the hinge arm 30, for example.

Additionally, since it is unnecessary to arrange any other counterweight in the front-side area Rf, a layout space of this counterweight and the weight of the vehicle body can be reduced.

Conventionally, a so-called seesaw type of lever is known as the door handle lever having the flush-surface structure. In this seesaw type of lever, the lever itself has the rotational support axis, and the lever is electrically rotated such that its one-end side is provided with the rotational support axis and the other-end side is projected from the door outer panel.

In this seesaw type of lever structure, however, since the lever itself has the rotational support axis as described above, it is necessary to arrange electrical components, such as a motor to rotate the rotational support axis, closely to an opening portion of the door outer panel where the lever is attached, so that there is a concern that the electrical components may become wet with the water easily.

Moreover, since it is difficult to project a whole part of the level including its one-end side provided with the rotational support axis from the door outer panel, there is another concern that it may become difficult for the user to grip the lever taking the gripping position.

Herein, a swan-neck hinge structure in which the rotational support axis is provided to be spaced apart, along the door outer panel, relative to the position of the lever may be useful in solving the above-described problems.

In the swan-neck hinge structure, however, the gravity position of the hinge arm is spaced apart from the hinge pin (rotational support axis) because the lever and the rotational are spaced apart from each other.

Therefore, there is a concern that when the large inertia force is applied to the hinge arm in the vehicle collision or the like, the lever provided at the one-end side of the hinge arm is so projected outwardly from the door panel that the door may be unlocked improperly.

Accordingly, in the swan-neck hinge structure, the gravity position of the hinge arm is conventionally made close to the hinge pin by providing the counterweight (weight object) at the opposite side of the hinge arm which is opposite to the side where the lever is arranged relative to the hinge pin.

However, in the swan-neck hinge structure, the driving unit (motor) to electrically rotate the hinge arm around the hinge pin is arranged at this opposite side of the hinge arm which is opposite to the side where the lever is arranged relative to the hinge pin.

Figure 13:
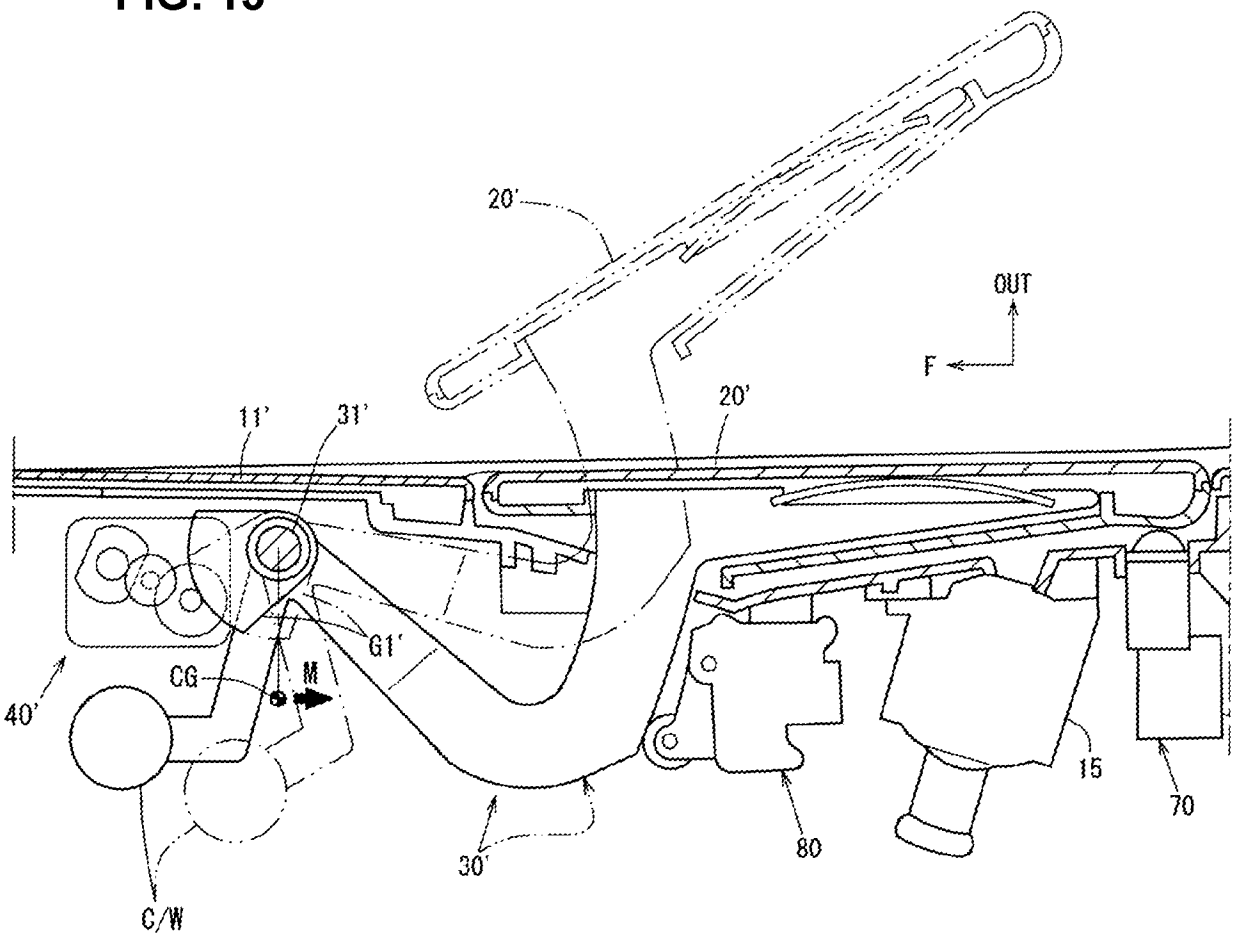
FIG. 13 is a plan view showing a major part of a conventional door handle structure.

Therefore, it may be considered as shown in FIG. 13 that a counterweight C/W is arranged at a position which is located on the inward side, in the vehicle width direction, of a driving unit 40' so as to avoid this driving unit 40'. FIG. 13 is a plan view showing a major part of the conventional door handle structure when a lever 20' takes the storage position. In the conventional door handle structure, a sector gear G1' is fixed to a hinge arm 30' so as to be rotated together with the hinge arm 30', and the driving unit 40' is fixed to a bracket of the door handle structure so as not to be rotated together with the hinge arm 30'.

As described above, a gravity position CG of the hinge arm 30' can be positioned to its forward side which is close to a hinge pin 31', in the longitudinal direction, from its rearward side where the lever 20' is arranged by providing the counterweight C/W on the forward side of the hinge pin 30' of the hinge arm 30'. However, by arranging the counterweight C/W at the position which is located on the inward side, in the vehicle width direction, of the driving unit 40' as described above, the gravity position CG of the hinge arm 30' is positioned on the inward side, in the vehicle width direction, of the hinge pin 31' (see FIG. 13).

Thereby, when the vehicle has a rear collision, a moment load (see an arrow M in FIG. 13) which causes the lever 20' provided at the one-end side of the hinge arm 30' to be swung around the hinge pin 31' and projected outwardly from a door outer panel 11' is generated at the hinge arm 30' (see the hinge arm 30' shown by an imaginary line in FIG. 13), so that there is a concern that the door may be unlocked improperly as described above.

Herein, since the present embodiment is configured such that the driving unit 40 itself is utilized as the counterweight as described above, the gravity position of the hinge arm 30 can be made properly close to the hinge pin 31 without interference of the driving unit 40 with any additional counterweight.

Accordingly, the lever 20 can be suppressed from being projected outwardly from the door outer panel 11 improperly when the large inertia force is applied to the hinge arm 30.

In the embodiment of the present invention, as shown in FIGS. 11 and 12, the hinge arm 30 is attached to the bracket 50 (a member which is provided on the side of the door outer panel 11) so as to rotate via the hinge pin 31, the wire harness 90 connected to the driving unit 40 is provided, and the wire harness 90 is fixed to a portion of the bracket 50 which is closely positioned to the hinge pin 31, i.e., to the harness fixation portion 69.

According to this structure, even if the harness connection portion 68 of the wire harness 90 is moved according to the position change of the lever 20 because of rotating of the hinge arm 30 where the driving unit 40 is fixed around the hinge pin 31, the length of the wire harness 90 between the connection portion 68 and the harness fixation portion 69 where the wire harness 90 is fixed closely to the hinge pin 31 can be suppressed from changing.

Specifically, since the driving unit 40 is fixed to the hinge arm 30 as described above, the distance between the driving unit 40 and the hinge pin 31 of the hinge arm 30 can be maintained substantially at a constant length while the driving unit 40 rotates around the rotational center (hinge pin 31) of the hinge arm 30.

Thus, by fixing the wire harness 90 to the portion of the bracket 50 which is positioned closely to the hinge pin 31 (specifically, to the hinge attachment portion 58), i.e., the harness fixation portion 69, changing of the length of the wire harness 90 between the harness connection portion 68 (specifically, the harness movable-side fixation portion 63) and the harness fixation portion 69 can be suppressed.

Accordingly, a load of a tensional direction or a compressive direction which is inputted to the wire harness 90 when the hinge arm 30 is rotated around the hinge pin 31 can be reduced, so that the counterweight-function performance of the driving unit 40 can be achieved without deteriorating the durability of the wire harness 90.

In the embodiment of the present invention, as shown in FIGS. 4 and 11, the lever 20 and the driving unit 40 are provided to face each other relative to the hinge pin 31 in the vehicle elevational view (in the vehicle width direction (see FIG. 4) and in the vertical direction (see FIG. 12)). That is, these 20, 40 are arranged on the identical straight line extending in the longitudinal direction (see the imaginary line La in FIG. 4) in the vehicle plan view and on the identical straight line extending in the longitudinal direction (see the imaginary line Lb in FIG. 11) in the inward side view, in the vehicle width direction, of the structure.

According to this structure, the gravity position of the hinge arm 30 having the lever 20 at its rear end can be made closer to the hinge pin 30.

In the embodiment of the present invention, as shown in FIG. 7, the bracket 50 (see FIGS. 11 and 12) which stores the lever 20 and is fixed to the door outer panel 11 and the sector gear G1 which is fixed to the bracket 50 are provided, and the driving unit 40 comprises the motor 42, the output axis 45 to transmit the power of the motor 42 to the hinge arm 30, and the pinion gear G5 which the output axis 45 is fitted into and engages with the sector gear G1.

According to this structure, by gear engagement, i.e., engaging of the sector gear G1 and the pinion gear G5, the poser of the motor 42 can be transmitted to the hinge arm 30 and also the motor 42 and the pinion gear G5 can be moved together with the hinge arm 30 along the engaging portion G1*b* of the sector gear G1 with the pinion gear G5 (see FIG. 8).

That is, the structure in which the driving unit 40 to perform the counterweight function for the lever 20 is provided in the front-side area Rf of the hinge arm 30 can be provided, so that the gravity position of the hinge arm 30 can be arranged closely to the hinge pin 31.

In the embodiment of the present invention, as shown in FIG. 7, the sector gear G1 is fixed to the hinge pin 31 of the hinge arm 30. According to this structure, since poisoning of the sector gear G1 and the hinge pin 31 around which the hinge arm 30 is rotated can be made precisely, the structure in which the driving unit 40 is fixed in the front-side area Rf of the hinge arm 30 so as to be movable together with the hinge arm 30 can be provided.

Accordingly, the gravity position of the hinge arm 30 can be securely arranged closely to the hinge pin 31.

Specifically, the poisoning of the sector gear G1 and the hinge pin 31 can be made precisely by fixing the sector gear G1 to the hinge pin 31.

Thereby, the hinge pin 31 which is the rotational center of the hinge arm 30 can be made to be fixed to a center position of the arc-shaped engagement portion G1*b* of the sector gear G1 with the pinion gear G5, so that the rotational center of the hinge arm 30 and the rotational center of the pinion gear G5 which moves along the engagement portion G1*b* of the sector gear G1 can be made to match each other. That is, the center of the arc-shaped engagement portion G1*b* of the sector gear G1 and the rotational center of the hinge arm 30 can be made coaxial.

Thereby, the distance between the output axis 45 fitted into the pinion gear G5 which moves along the engagement portion G1*b* of the sector gear G1 and the axis of the hinge pin 31 which is the rotational center of the hinge arm 30 can be maintained at the constant length while the lever 20 moves.

Accordingly, the structure in which the driving unit 40 is fixed in the opposite area of the hinge arm 30 so as to be movable together with the hinge arm 30 can be provided, so that the gravity center of the hinge arm 30 can be positioned closely to the hinge arm 31 securely.

Further, since the positioning accuracy of the sector gear G1 and the hinge pin 31 can be controlled easily, an assembling error of the hinge arm 30 to the sector gear G1 via the hinge pin 31 can be properly diminished.

In the embodiment of the present invention, as shown in FIGS. 11 and 12, the driving unit 40 comprises the motor 42 and the water-proof cap 65 (water-proof member) which covers over the motor 42, and has the harness connection portion 68 where the wire harness 90 is connected, and the harness connection portion 68 is positioned at the water-proof cap 65.

According to this structure, the durability of the driving unit 40 against its becoming wet with the water can be improved.

Specifically, since the door inside (a space between a door inner panel, not illustrated, and the door outer panel 11) corresponds to an area where the water may exist, there is a concern that in a rainy day or at car washing, for example, the water coming into the door inside through a gap between the door window glass 10 and the door body 9 may drop toward the door handle structure.

Further, the driving unit 40 moves outwardly (inwardly, in the vehicle width direction, of the structure) from the inside of the bracket 50 according to the position change of the lever 20 because the hinge arm 30 rotates around the hinge pin 31 (see FIG. 8, for example). Therefore, the driving unit 40 becomes wet with the water easily.

Herein, by providing the water-proof cap 65 covering over the motor 42 as shown in FIGS. 11 and 12, the water can be prevented from coming into the inside of the motor 42.

In the present embodiment, the water-proof cap 65 comprises the upper wall portion 65 and the peripheral wall portion 67, this cap 65 is attached such that it is pushed down over the motor 42, and a gap between an inner surface of the peripheral wall portion 67 and an outer surface of the motor 42 is configured to be opened downwardly. Therefore, even if the water drops onto the upper wall portion 66 of the water-proof cap 65, for example, this water which tends to flow down from an upper face of the upper wall portion 66 to a lower portion of the motor 42 along an outer surface of the peripheral wall portion 67 can be prevented from coming into the inside of the motor 42 through the gap between the inner surface of the peripheral wall portion 67 and the outer surface of the motor 42.

Further, since the harness connection portion 68 is positioned at the water-proof cap 65 covering over the motor 42, this harness connection portion 68 can be suppressed from becoming wet with the water which drops from an upper side of the door handle structure and remains at the lower wall 50B of the bracket 50. Thus, the harness connection portion 68 can be positioned at an appropriate location against the water.

The present invention is not limited to the above-described embodiment, but can be materialized by various modifications.

The lever of the present invention is not limited to the lever 20 of the above-described embodiment which is formed integrally with another portion of the hinge arm 30 than the lever 20, but the lever may be formed separately from this other portion of the hinge arm 30 as long as the lever is provided at the one-end side of the hinge arm relative to the rotational support axis.

Further, the driving unit of the present invention is not limited to the driving unit 40 of the present embodiment. For example, it may be a crank-operational type of device which comprises an output axis to transmit a rotational force of the motor and a crank which has its base end fixed to the output axis and its free end configured to contact the bracket and be slidable.

What is claimed is:

1. A door handle structure of a vehicle, comprising:

a hinge arm having a lever to be gripped by a user and a rotational support axis to rotate the lever so as to be projected from a door panel; and a driving unit to transmit a drive force to the hinge arm, wherein said lever is configured to be rotatable among a storage position where the lever is flush with the door panel, a gripping position where the lever is projected from the door panel by driving of said driving unit so that the user is able to grip the lever, and an open position where the lever is further projected from said gripping position, said driving unit is fixed to an extension portion of the hinge arm located in an area of said hinge arm which is opposite, relative to said rotational support axis, to an area of the hinge arm where said lever is arranged, said area of the hinge arm where the lever is arranged and said driving unit are provided to face each other relative to said rotational support axis when the lever is in the storage position, and the driving unit comprises a motor base attached to the extension portion of the hinge arm, and a motor attached to the motor base to rotate the driving unit together with the hinge arm so that the lever is projected from the door panel.

2. The door handle structure of the vehicle of claim 1, wherein said hinge arm is attached to a member which is provided on a side of said door panel so as to rotate via said rotational support axis, a wire harness connected to said driving unit is provided, and said wire harness is fixed to a portion of said member which is closely positioned to said rotational support axis.

3. The door handle structure of the vehicle of claim 2, wherein said lever and said driving unit are provided to face each other relative to said rotational support axis.

4. The door handle structure of the vehicle of claim 3, wherein a bracket which stores said lever and is fixed to the door panel and a sector gear which is fixed to said bracket are provided, and said driving unit comprises an output axis to transmit a power of said motor to said hinge arm, and a pinion gear which said output axis is fitted into and engages with said sector gear.

5. The door handle structure of the vehicle of claim 4, wherein said sector gear is fixed to said rotational support axis of the hinge arm.

6. The door handle structure of the vehicle of claim 2, wherein said driving unit comprises a water-proof member which covers over said motor, and has a harness connection portion where said wire harness is connected, and said harness connection portion is positioned at said water-proof member.

7. The door handle structure of the vehicle of claim 1, wherein said lever and said driving unit are provided to face each other relative to said rotational support axis.

8. The door handle structure of the vehicle of claim 1, wherein a bracket which stores said lever and is fixed to the door panel and a sector gear which is fixed to said bracket are provided, and said driving unit comprises an output axis to transmit a power of said motor to said hinge arm, and a pinion gear which said output axis is fitted into and engages with said sector gear.

9. The door handle structure of the vehicle of claim 2, wherein a bracket which stores said lever and is fixed to the door panel and a sector gear which is fixed to said bracket are provided, and said driving unit comprises an output axis to transmit a power of said motor to said hinge arm, and a pinion gear which said output axis is fitted into and engages with said sector gear.

10. The door handle structure of the vehicle of claim 7, wherein a bracket which stores said lever and is fixed to the door panel and a sector gear which is fixed to said bracket are provided, and said driving unit comprises an output axis to transmit a power of said motor to said hinge arm, and a pinion gear which said output axis is fitted into and engages with said sector gear.

11. The door handle structure of the vehicle of claim 8, wherein said sector gear is fixed to said rotational support axis of the hinge arm.

* * * * *